US009028021B2

(12) United States Patent
Uetsuki et al.

(10) Patent No.: US 9,028,021 B2
(45) Date of Patent: May 12, 2015

(54) INK FILLING METHOD AND INKJET RECORDING APPARATUS

(71) Applicant: Canon Kabushiki Kaisha, Tokyo (JP)

(72) Inventors: Masaya Uetsuki, Yokohama (JP); Taku Yokozawa, Yokohama (JP); Toshimitsu Danzuka, Tokyo (JP); Masataka Kato, Yokohama (JP); Tsuyoshi Ibe, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/868,845

(22) Filed: Apr. 23, 2013

(65) Prior Publication Data

US 2013/0286065 A1 Oct. 31, 2013

(30) Foreign Application Priority Data

Apr. 26, 2012 (JP) ..... 2012-100963

(51) Int. Cl.

| | |
|---|---|
| ***B41J 2/195*** | (2006.01) |
| ***B41J 2/17*** | (2006.01) |
| ***B41J 2/175*** | (2006.01) |
| ***B41J 29/38*** | (2006.01) |

(52) U.S. Cl.

CPC ..... *B41J 2/17566* (2013.01); *B41J 2/175* (2013.01); *B41J 2/17509* (2013.01); *B41J 2/17523* (2013.01); *B41J 2/17553* (2013.01); *B41J 29/38* (2013.01); *B41J 2002/17579* (2013.01)

(58) Field of Classification Search

CPC ..... B41J 2/17566; B41J 2/175
USPC ..... 347/7, 84–87
See application file for complete search history.

(56) References Cited

U.S. PATENT DOCUMENTS

| | | | | |
|---|---|---|---|---|
| 2002/0024543 | A1* | 2/2002 | Kimura et al. | 347/7 |
| 2008/0238979 | A1* | 10/2008 | Umeda | 347/17 |
| 2011/0050794 | A1* | 3/2011 | Koike et al. | 347/22 |
| 2011/0181670 | A1* | 7/2011 | Tsubaki | 347/85 |

FOREIGN PATENT DOCUMENTS

| | | | |
|---|---|---|---|
| JP | 2010-208151 | A1 | 9/2010 |

* cited by examiner

*Primary Examiner* — Jason Uhlenhake
(74) *Attorney, Agent, or Firm* — Canon USA Inc IP Division

(57) ABSTRACT

An inkjet recording apparatus includes a recording head, a carriage with the recording head mounted thereon, a main tank, a sub-tank configured to be supplied with ink from the main tank via a tube, a supply tube configured to connect the recording head and the sub-tank, a supply unit connected to the supply tube and configured to supply ink from the main tank to the sub-tank, and a control unit configured to control acceleration of the carriage and to control the supply unit, wherein, when an empty volume in the sub-tank is greater than or equal to an ink volume in the main tank, the supply unit is controlled to supply ink to the sub-tank.

15 Claims, 11 Drawing Sheets

INK FILLING METHOD AND INKJET RECORDING APPARATUS

BACKGROUND

1. Field

Aspects of the present invention generally relate to an ink filling method for filling a sub-tank with ink from a main tank disposed in an inkjet recording apparatus, and an inkjet recording apparatus employing the method.

2. Description of the Related Art

Recently, an ink jet recording apparatus has been used to record various types of images on a large recording medium such as A1 size and A0 size. This type of inkjet recording apparatus generally employs a configuration in which an inkjet recording head (hereinafter referred to as a recording head) mounted on a carriage performing reciprocating scanning in a main scanning direction is connected via a tube to a large-volume main tank (hereinafter referred to a main tank) to supply ink to the recording head.

The large inkjet recording apparatus has a wide range of uses including recording of various types of images from monochrome line drawings to photographic tone images. When the large inkjet recording apparatus records an image having a high printing duty such as a photographic tone image, a large amount of ink is consumed. Although the large-volume main tank is used in the large inkjet recording apparatus, a large amount of ink can be consumed depending on the type of recording image or the volume of printing. The consumption of a large amount of ink causes an increase in frequency of main tank replacement.

When the main tank is connected via the tube to the recording head, a recording operation needs to be stopped to replace the main tank. This decreases the recording efficiency due to a waste of time for replacing the main tank. Moreover, if a recording operation is interrupted in the middle of recording on one recording medium for main tank replacement, the lapse of time causes color unevenness between before and after the interruption and deteriorates image quality.

Accordingly, Japanese Patent Application Laid-Open No. 2010-208151 discusses an inkjet recording apparatus including a sub-tank disposed between a main tank and a recording head so that the main tank can be replaced without interrupting a recording operation. In Japanese Patent Application Laid-Open No. 2010-208151, the main tank is connected to the sub-tank, and ink is moved from the main tank to the sub-tank to fill the sub-tank with the ink. Then, the ink is supplied from the sub-tank to the recording head connected via a tube, so that a recording operation is performed. In such a configuration, even if ink inside the main tank is used up, the inkjet recording apparatus can continue a recording operation using ink stored inside the sub-tank. Thus, the main tank can be replaced while the recording operation is performed using the ink inside the sub-tank. Therefore, the main tank can be replaced without interrupting the recording operation, thereby preventing a decrease in recording efficiency due to a waste of time for replacing the main tank and a deterioration in image quality due to a lapse of time.

In Japanese Patent Application Laid-Open No. 2010-208151, a valve capable of blocking an ink supply flow path is disposed in a middle portion of the tube. The tube serves as the ink supply flow path, and connects the sub-tank to the recording head. This valve includes a volume-changeable member (hereinafter referred to as a diaphragm valve), and the operation of this diaphragm valve can cause negative pressure in the sub-tank. When the sub-tank needs to be filled with ink supplied from the main tank, the diaphragm valve is operated to cause the negative pressure in the sub-tank. This negative pressure enables ink to be pulled into the sub-tank from the main tank.

However, when the diaphragm valve disposed between the sub-tank and the recording head is operated to fill the sub-tank with ink, the ink path connecting the sub-tank to the recording head needs to be repeatedly closed and opened. Consequently, when the diaphragm valve is operated, ink cannot be supplied to the recording head, and thus the inkjet recording apparatus cannot continue the recording operation. That is, the ink filling operation to the sub-tank cannot be performed along with the recording operation. The recording operation is interrupted during the ink filling to the sub-tank since the ink filling operation needs to be performed independently from the recording operation, thereby causing a decrease in the recording efficiency.

Accordingly, inventors of the present invention have studied an inkjet recording apparatus capable of filling a sub-tank with ink from a main tank using dynamic pressure of ink in a tube, the dynamic pressure being generated by the acceleration of a carriage. In the recording apparatus having the main tank and the sub-tank, even when the carriage is not accelerating, the same amount as the amount of ink used for a recording operation (also referred to as a recording ink amount) is supplied from the main tank to the sub-tank. The amount of ink is supplied since the pressure inside the sub-tank is reduced when the ink in the sub-tank is used by the recording operation.

That is, in the recording apparatus studied by the inventors of the present invention, the amount of ink used for recording and the amount of ink moved by using the dynamic pressure are supplied from the main tank to the sub-tank. In terms of the sub-tank only, the amount of ink thereof is increased by the amount of ink moved by the dynamic pressure.

However, in a case where there is not much ink in the main tank to fill the sub-tank with ink by the dynamic pressure, ink in the main tank may become empty before the sub-tank is filled with a sufficient amount of ink. In case of such a situation, an ink shortage may occur during recording of one image, although the recording apparatus has the sub-tank.

SUMMARY

An aspect of the present invention is generally relates to a high-reliability inkjet recording apparatus capable of preventing a decrease in recording efficiency due to interruption of a recording operation, and reliably filling a sub-tank with ink before ink in a main tank runs out.

According to an aspect of the present invention, an inkjet recording apparatus includes a recording head including a discharge port, a carriage configured to perform reciprocating scanning with the recording head mounted thereon, a main tank configured to store ink, a sub-tank configured to be supplied with ink from the main tank via a tube, a supply tube configured to connect the recording head and the sub-tank, a supply unit connected to the supply tube and configured to supply ink from the main tank to the sub-tank, and a control unit configured to control acceleration of the carriage such that a dynamic pressure of ink inside the supply tube becomes greater than a pressure resistance to an ink movement and a pressure resistance to an air movement in the tube, and to control the supply unit, wherein, when an empty volume in the sub-tank is greater than or equal to an ink volume in the main tank, the control unit controls the supply unit to supply ink to the sub-tank.

According to an exemplary embodiment, when acceleration of a carriage is controlled, ink is supplied from a main tank to a sub-tank, and when an empty volume in the sub-tank becomes greater than or equal to an ink volume in the main tank, ink is forcibly supplied from the main tank to the sub-tank. Thus, a high-reliability inkjet recording apparatus capable of suppressing a decrease in recording efficiency due to a waste of time and preventing interruption of a recording operation during printing of one image is provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1A:
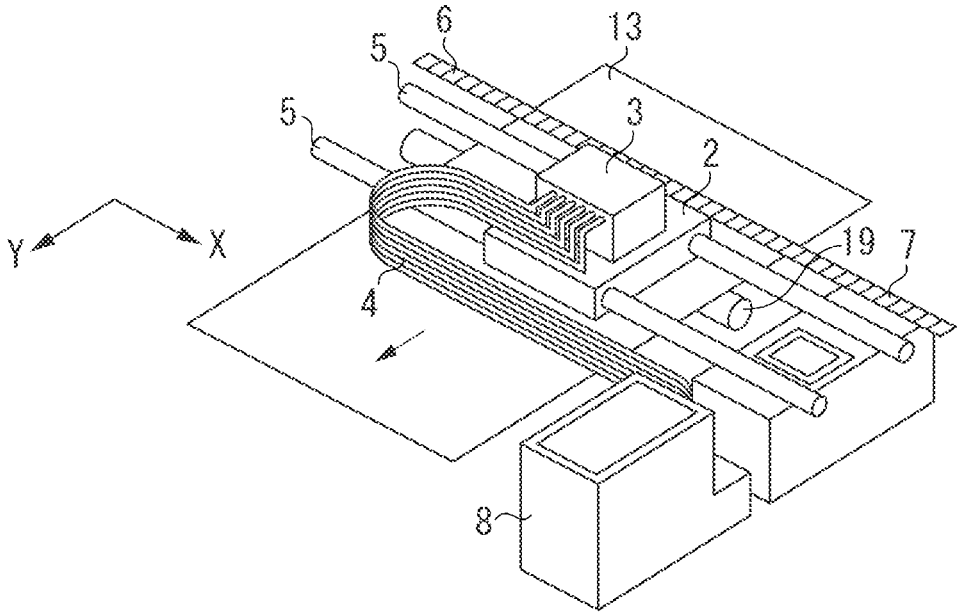
FIG. 1A is a perspective view schematically illustrating an inkjet recording apparatus according to an exemplary embodiment

Various exemplary embodiments, features, and aspects of the invention will be described in detail below with reference to the drawings.

An inkjet recording apparatus can be used to perform a recording operation on a recording medium by discharging ink. Particularly, the inkjet recording apparatus can be applied to devices such as a printer, a copying machine, business equipment such as a facsimile apparatus, and industrial production equipment. The use of such an inkjet recording apparatus enables recording to be performed on various recording media made of paper, thread, fiber, cloth, leather, metal, plastic glass, wood, and ceramic.

The term "recording" used throughout the present specification represents not only a case where a meaningful image such as characters and graphics is provided on a recording medium, but also a case where a meaningless image such as patterns is provided on a recording medium.

Moreover, the term "ink" should be broadly interpreted. The ink is liquid that is provided on a recording medium so that an image, a design, and a pattern are formed, the recording medium is processed, or ink processing or recording medium processing is performed.

An exemplary embodiment will now be described with reference to drawings. In the following description, components having substantially the same configuration are given the same reference numerals throughout the drawings, and description thereof may be omitted in some cases.

(Schematic Configuration of Apparatus Body)

Figure 1B:
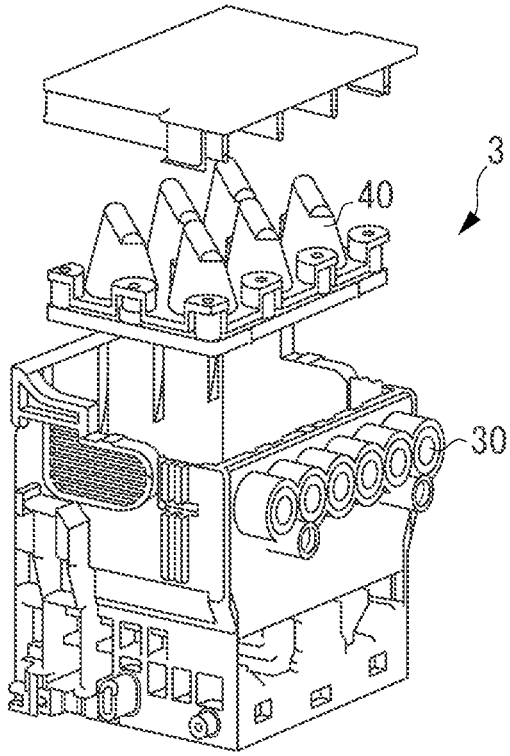
FIG. 1B is an exploded perspective view illustrating one portion of a recording head according to the exemplary embodiment.

FIGS. 1A and 1B are perspective views illustrating a recording apparatus main body of an inkjet recording apparatus performing a recording operation on a recording medium 13. The inkjet recording apparatus in the present exemplary embodiment is a serial-type inkjet recording apparatus that performs a recording operation by causing a recording head to perform reciprocating scanning in a recording width direction of a recording medium. The serial-type inkjet recording apparatus intermittently conveys the recording medium 13 in a direction indicated by an arrow Y in FIG. 1A (a sub-scanning direction) using a conveyance roller 19. With the conveyance of the recording medium 13 in the direction Y, the serial-type inkjet recording apparatus performs a recording operation while causing a recording head 3 mounted on a carriage 2 to perform reciprocating scanning in a direction indicated by an arrow X in FIG. 1A (a main scanning direction). The direction X is perpendicular to the direction Y which is a conveyance direction of the recording medium 13. A recording apparatus main body illustrated in FIGS. 1A and 1B is, for example, a large inkjet recording apparatus capable of performing recording on a recording medium such as A1 size and A0 size.

The recording head 3 is detachably mounted on the carriage 2, and can discharge supplied ink from a plurality of discharge ports. The carriage 2 performs reciprocating scanning along the direction X illustrated in FIG. 1A with the recording head 3 mounted thereon. Particularly, the carriage 2 is movably supported along guide rails 5 disposed along the direction X, and is fixed to an endless belt 6 moving in parallel with the guide rails 5. The endless belt 6 is moved in a reciprocating manner by drive force of a carriage motor (CR motor), so that the carriage 2 performs reciprocating scanning in the direction X.

An ink supply system 8 includes a plurality of main tanks independently provided for each of color inks. The ink supply system 8 is described in detail with reference to FIG. 3. The ink supply system 8 is connected to the recording head 3 by a plurality of ink supply tubes 4 provided for each of color inks. Each ink supply tube 4 is made of a flexible material. Moreover, the attachment of these main tanks to the ink supply system 8 enables each of color inks stored inside the main tanks to be independently supplied to one of nozzle arrays of the recording head 3. In the recording apparatus main body, a recovery processing device 7 is also disposed. The recovery processing device 7 recovers and maintains an ink discharge state of the recording head 3.

(Recording Head)

FIG. 1B is an exploded perspective view illustrating one portion of the recording head 3 to be mounted on the carriage 2 of the inkjet recording apparatus. The recording head 3 is supplied with ink from the recording apparatus main body via the ink supply tube 4 by a connection unit 30. The ink supplied by the connection unit 30 is temporarily stored in a reservoir (not illustrated) disposed for each ink color, and discharged when a recording operation is performed. A pressure adjustment member 40 including an elastically deformable rubber member is connected to the reservoir. A change in volume of the pressure adjustment member 40 can adjust the pressure inside the reservoir. Particularly, the pressure adjustment member 40 has a volume of approximately 1.4 ml, and can allow a volume change of approximately ±0.3 ml.

(Control System)

Figure 2:
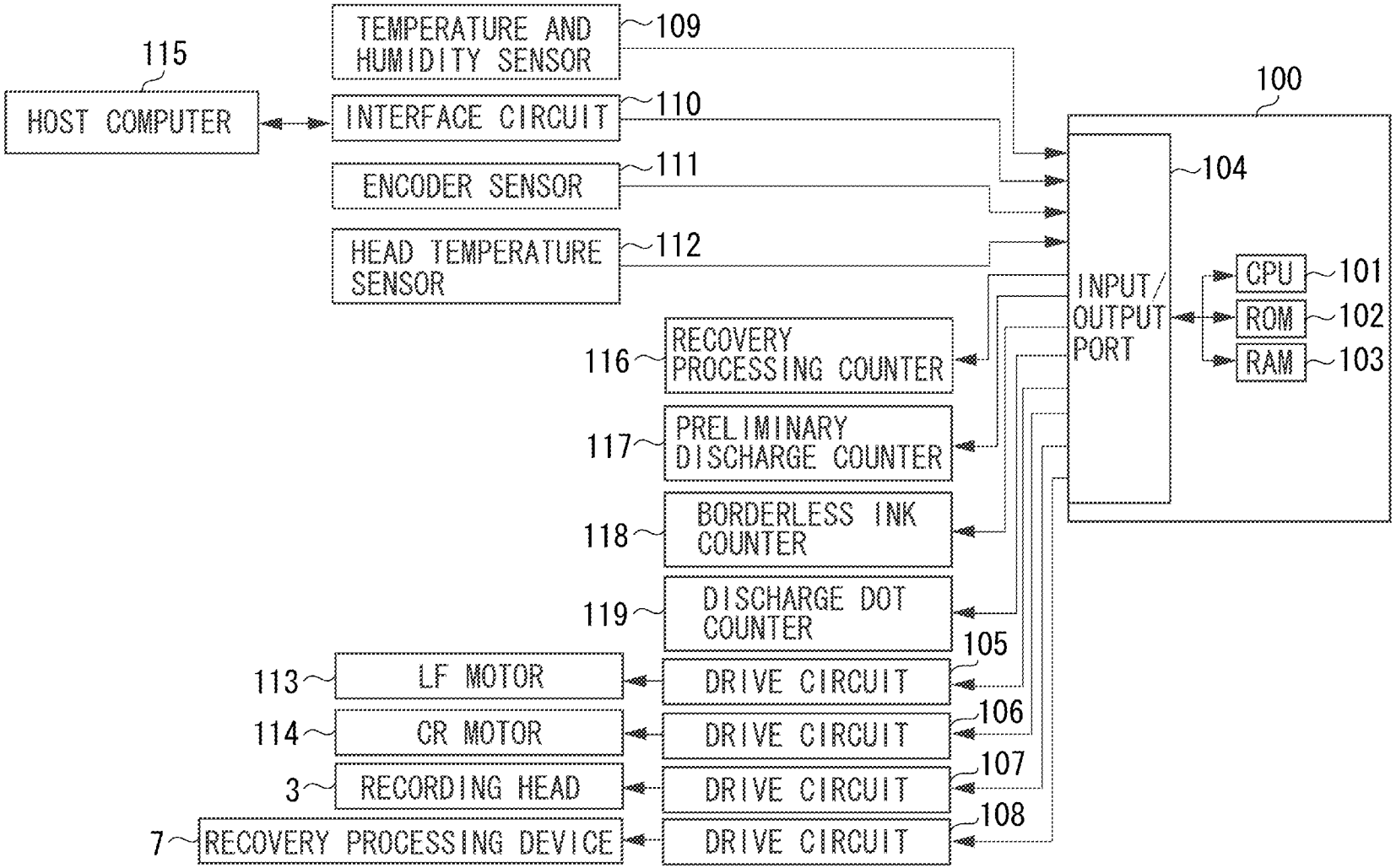
FIG. 2 is a block diagram schematically illustrating a configuration of a control system mounted on an inkjet recording apparatus main body.

FIG. 2 is a block diagram illustrating a configuration example of a control system (a control unit) mounted on the recording apparatus main body of the inkjet recording apparatus according to the present exemplary embodiment. In FIG. 2, a main control unit 100 includes a central processing unit (CPU) 101 for executing various processing operations such as calculation, control, determination, and settings. Moreover, the main control unit 100 includes a read only memory (ROM) 102, a random access memory (RAM) 103, and an input/output port 104. The ROM 102 stores control programs to be executed by the CPU 101. The RAM 103 is used as a buffer storing binary recording data indicating discharge/non-discharge of ink, and used as a work area of processing executed by the CPU 101. In addition, the RAM 103 can be used as a storage unit for storing values of ink amounts in the main tank and values of empty volumes in the sub-tank before and after recording operation.

The input/output port 104 is connected to drive circuits 105, 106, 107, and 108 respectively provided for a conveyance motor (LF motor) 113 for driving a conveyance roller, a carriage motor (CR motor) 114, the recording head 3, and the recovery processing device 7. Each of these drive circuits 105, 106, 107, and 108 is controlled by the main control unit 100. The input/output port 104 is connected to various sensors such as a head temperature sensor 112, an encoder sensor 111 fixed to the carriage 2, and a temperature and humidity sensor 109. The head temperature sensor 112 detects temperature of the recording head 3, and the temperature and humidity sensor 109 detects temperature and humidity in the usage environment of the recording apparatus main body. The main control unit 100 is connected to a host computer 115 via an interface circuit 110.

A recovery processing counter 116 counts the amount of ink forcibly discharged from the recording head 3 by the recovery processing device 7. A preliminary discharge counter 117 counts the amount of ink preliminarily discharged before a recording operation is started, when a recording operation is finished, or during a recording operation. A borderless ink counter 118 counts the amount of ink recorded outside the area of a recording medium when borderless recording is performed. A discharge dot counter 119 counts the amount of ink discharged during a recording operation.

A recording operation executed by the inkjet recording apparatus with such a configuration is now described. When the inkjet recording apparatus receives recording data from the host computer 115 via the interface circuit 110, the recording data is loaded into a buffer of the RAM 103. When a recording operation is instructed, the conveyance roller 19 operates to convey a recording medium 13 to a position facing the recording head 3. The carriage 2 moves along the guide rails 5 in the direction X illustrated in FIG. 1A. With the movement of the carriage 2, ink droplets are discharged from the recording head 3, and one band of an image is recorded on the recording medium 13. Subsequently, the recording medium 13 is conveyed for one band in the direction Y perpendicular to the carriage 2 by a conveyance unit. Such an operation is repeated, so that a predetermined image is formed on the recording medium 13.

A position of the carriage 2 is detected by counting a pulse signal by the main control unit 100, the pulse signal being output from the encoder sensor 111 with the movement of the carriage 2. That is, the encoder sensor 111 outputs a pulse signal to the main control unit 100 upon detection of each of detection portions arranged with a predetermined distance therebetween on an encoder film (not illustrated) placed along the direction X. The main control unit 100 counts these pulse signals, thereby detecting the position of the carriage 2. The carriage 2 moves to a home position or other positions based on the signals from the encoder sensor 111.

(Ink Supply System)

Figure 3:
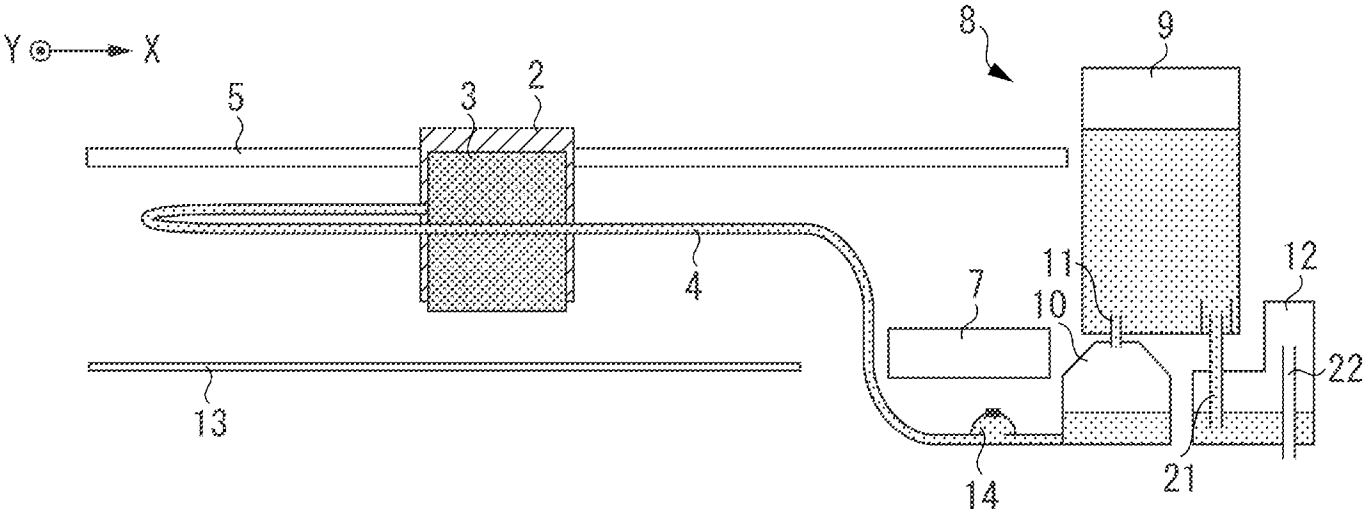
FIG. 3 is a schematic diagram illustrating an ink supply system.

FIG. 3 is a schematic diagram illustrating a configuration of an ink supply system of the inkjet recording apparatus according to the present exemplary embodiment. That is, FIG. 3 schematically illustrates the ink supply system 8, the recording head 3, and the supply tube 4 connecting the ink supply system 8 and the recording head 3. Herein, one supply tube 4 is illustrated for the sake of simplicity.

In FIG. 3, the ink supply system 8 is disposed in a predetermined position in the recording apparatus main body. The ink supply system 8 includes a main tank 9, a sub-tank 10, a hollow tube 11 for connecting the main tank 10 and the sub-tank 9, a buffer chamber 12, a communication tube 21 for connecting the main tank 9 and the buffer chamber 12, and a diaphragm valve 14. The supply tube 4 is formed of a flexible material, and connects the sub-tank 10 and the recording head 3. The supply tube 4 connected to the sub-tank 10 has a portion parallel to a moving/scanning direction of the carriage 2. As illustrated in FIG. 3, the supply tube 4 extends inside the recording apparatus main body such that the supply tube 4 is connected to a left side of the recording head 3 by being folded back in a middle portion thereof. That is, the supply tube 4 is arranged to include a portion parallel to the guide rails 5. The arrangement of the supply tube 4 illustrated in FIG. 3 is merely one example, and is not limited thereto.

The main tank 9 is detachably mounted on the recording apparatus main body. In the inkjet recording apparatus according to the present exemplary embodiment, the main tank 9 stores a greater volume of ink than the sub-tank 10. Moreover, the main tank 9 communicates with the sub-tank 10 via the hollow tube 11, and communicates with the buffer chamber 12 via the communication tube 21. The main tank 9 is connected to the hollow tube 11 and the buffer chamber 12 at the bottom thereof when the main tank 9 is attached to the recording apparatus main body. The main tank 9 is hermetically closed except for these connection portions.

The sub-tank 10 is disposed in a lower position than that of the recording head 3 in the direction of gravity. The sub-tank 10 includes a ceiling portion formed in a dome shape or with an inclined surface, and the hollow tube 11 is connected to a upper portion of the sub-tank 10 in the direction of gravity. In FIG. 3, the hollow tube 11 is connected to a position, which is an uppermost portion of the sub-tank 10, and has an intrusion amount of substantially 0 mm with respect to the sub-tank 10.

When an end portion of the hollow tube 11 is in a position not in contact with ink inside the sub-tank 10, dynamic pressure of ink inside the supply tube 4 is used to fill the sub-tank 10 with the ink, and the diaphragm valve 14 (a supply unit) is used to forcibly fill the sub-tank 10 with the ink. That is, since a position of the hollow tube 11 inside the sub-tank 10 becomes an ink position at the time of completion of filling the sub-tank 10 with the ink, an appropriate adjustment in the intrusion amount of the hollow tube 11 can control a full-up amount of ink inside the sub-tank 10.

Moreover, the sub-tank 10 communicates with the supply tube 4 communicating with the recording head 3 in a lower portion thereof (near the bottom), that is, the sub-tank 10 communicates with the supply tube 4 in a position always in contact with ink. Substantially, the sub-tank 10 is hermetically closed except for the connection portions to the hollow tube 11 and the supply tube 4. As long as the sub-tank 10 is substantially closed in a hermetic manner during the filling of the sub-tank 10 with ink, the sub-tank 10 may not necessarily be hermetically closed at a time other than the time of the ink filling to the sub-tank 10. Even during the filling of the sub-tank 10 with ink, the sub-tank 10 may have a communication location having a higher pressure resistance than an ink movement pressure-resistance Pi and an air movement pressure-resistance Pa described below.

In the hollow tube 11, ink and air can be moved depending on the internal pressure inside the sub-tank 10. However, the ink does not move spontaneously from the main tank 9 to the sub-tank 10 by gravity. For example, the hollow tube 11 has an inner diameter large enough to have flow path resistance which allows the ink to be moved smoothly. At the same time, the hollow tube 11 has an inner diameter large enough (e.g., an inner diameter of 1 to 2 mm) for the ink to have meniscus in an opening thereof.

The buffer chamber 12 is connected to the main tank 9 via the communication tube 21, and the communication tube 21 extends to near the bottom of the buffer chamber 12. Moreover, the buffer chamber 12 includes an atmosphere communication tube 22 for releasing (communicating with) the air, while the buffer chamber 12 is connected to the main tank 9 via the communication tube 21. One end of the atmosphere communication tube 22 is arranged in an upper portion inside the buffer chamber 12, and the other end is arranged outside buffer chamber 12. This arrangement maintains a balance between internal pressure of the main tank 9 and atmospheric pressure. The buffer chamber 12 functions as a space for storing the ink moved from the main tank 9, owing to changes in external environments. FIG. 3 illustrates a state in which there is some ink in the buffer chamber 12, and the communication tube 21 connected to the main tank 9 is filled with ink while one of the ends of the communication tube 21 is positioned inside the ink. This illustrates a state in which the ink is moved from the main tank 9 to the buffer chamber 12. Even in such a state, a shape of the buffer chamber 12 and an arrangement of the atmosphere communication tube 22 can be appropriately selected to maintain communication between the inside of the buffer chamber 12 and the atmosphere.

Figure 4A:
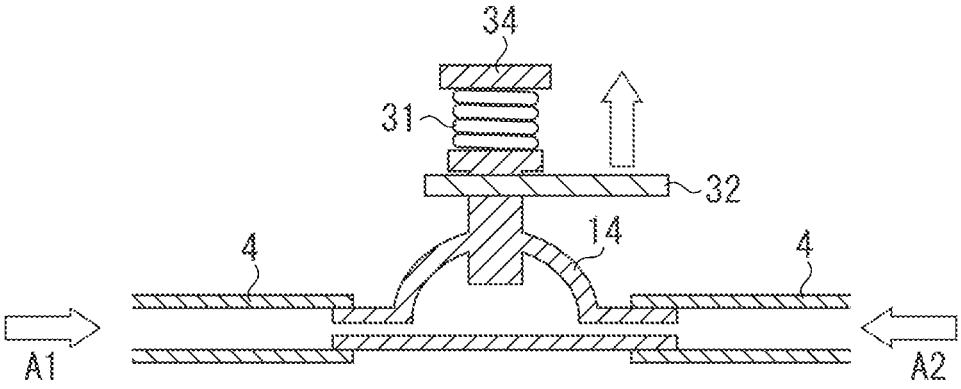
FIGS. 4A and 4B are cross sectional views illustrating a configuration of a diaphragm valve.
Figure 4B:
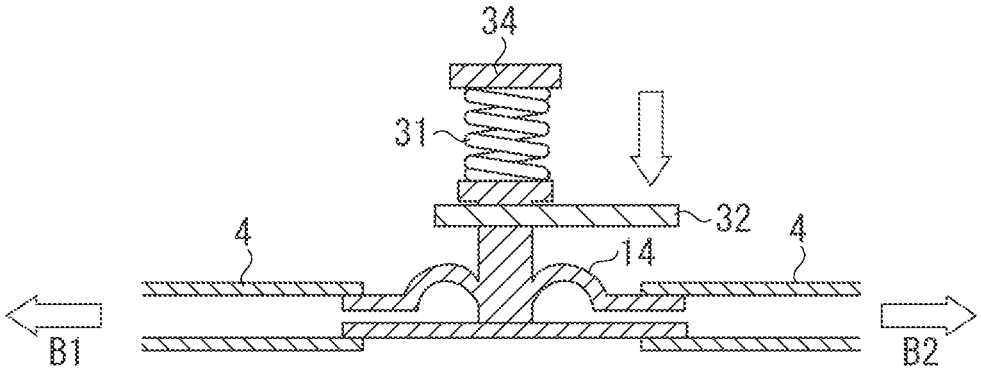

The diaphragm valve 14 made of a volume-changeable flexible material is arranged in a middle portion of the supply tube 4 for connecting the sub-tank 10 and the recording head 3. The diaphragm valve 14 switches between a closed state in which an ink flow path is closed by reducing volume of the diaphragm valve 14, and an open state in which the ink flow path is opened by increasing the volume of the diaphragm valve 14. FIGS. 4A and 4B are cross sectional views illustrating the supply of ink by the diaphragm valve 14.

The diaphragm valve 14 can change volume thereof using a spring 31, a lever 32, and a spring holding member 34. FIG. 4A illustrates a state in which a volume of the diaphragm valve 14 is maximal. Herein, an upward movement of the lever 32 as illustrated in FIG. 4A increases the volume of the diaphragm valve 14, so that the ink is supplied into the diaphragm valve 14 from the supply tube 4 in a direction A1 (a recording head side) and a direction A2 (a sub-tank side). FIG. 4B illustrates a state in which a volume of the diaphragm valve 14 is minimal. Herein, a downward movement of the lever 32 as illustrated in FIG. 4B reduces the volume of the diaphragm valve 14, so that the ink is supplied from the inside of the diaphragm valve 14 toward a direction B1 (a recording head direction) and a direction B2 (a sub-tank direction) of the supply tube 4. When the sub-tank 10 is full of ink, and there is no space in an upper portion thereof, ink returns to the main tank 9. However, if there is space, the pressure generated when the ink returns to the sub-tank 10 pushes the air in the space back to the main tank 9. Then, when the volume of the diaphragm valve 14 is increased again as illustrated in FIG. 4A, the ink is pulled back toward the direction A2 from the supply tube 4 connected to the sub-tank side. Consequently, the sub-tank 10 has negative pressure thereinside, and the ink in the main tank 9 is supplied into the sub-tank 10. The pressure adjustment member 40 cancels the fluctuations of pressure generated on the recording head side during each operation. Such operations are repeated to forcibly fill the sub-tank 10 with the ink. Since the ink flow path connecting the sub-tank 10 and the recording head 3 needs to be repeatedly closed and opened when the sub-tank 10 is forcibly filled with the ink, the inkjet recording apparatus cannot supply ink to the recording head 3. Thus, the inkjet recording apparatus cannot continue a recording operation.

Next, a description is given of a case where a recording operation causes the sub-tank 10 to be filled with ink.

When a recording operation is executed, ink is discharged from a discharge port of the recording head 3 and consumed. Accordingly, the pressure inside the sub-tank 10 becomes negative via the supply tube 4. When this negative pressure exceeds the flow path resistance and the meniscus pressure-resistance of the hollow tube 11, the ink is supplied from the main tank 9 to the sub-tank 10. That is, the amount of ink inside the main tank 9 is decreased by the amount of ink consumed by the recording operation.

When the supply of ink causes the pressure inside the main tank 9 to be negative, and there is no ink inside the buffer chamber 12, the atmosphere is introduced into the main tank 9 via the communication tube 21 and the buffer chamber 12 communicating with the atmosphere via the atmosphere communication tube 22, thereby eliminating the negative pressure.

When the buffer chamber 12 has ink thereinside and the communication tube 21 communicates with the ink as illustrated in FIG. 3, the ink inside the buffer chamber 12 returns to the main tank 9 via the communication tube 21, thereby eliminating the negative pressure inside the main tank 9.

If the inkjet recording apparatus continues a recording operation, the ink stored in the main tank 9 is eventually used up, and replacement of the main tank 9 becomes necessary. During the replacement of the main tank 9, the inkjet recording apparatus can continue the recording operation using the ink inside the sub-tank 10.

After the ink stored in the main tank 9 is used up, and then the ink stored in the sub-tank 10 is consumed for the recording operation, there is a possibility that the sub-tank 10 does not have a sufficient amount of ink to perform a recording operation on a relatively large recording medium such as A0 size and A1 size.

Herein, if a forcible filling method for forcibly filling the sub-tank 10 with ink by using the diaphragm valve 14 is always used, a recording operation always needs to be stopped after replacement of the main tank 9. This causes a decrease in the recording efficiency. Therefore, the present inventors have studied an ink filling method using dynamic pressure of the ink inside a tube to fill the sub-tank 10 with ink during the recording operation.

Such an ink filling method using dynamic pressure is described with reference to FIGS. 5A, 5B, 5C, 5D, 5E, and 5F, and FIGS. 6A and 6B.

Figure 5A:
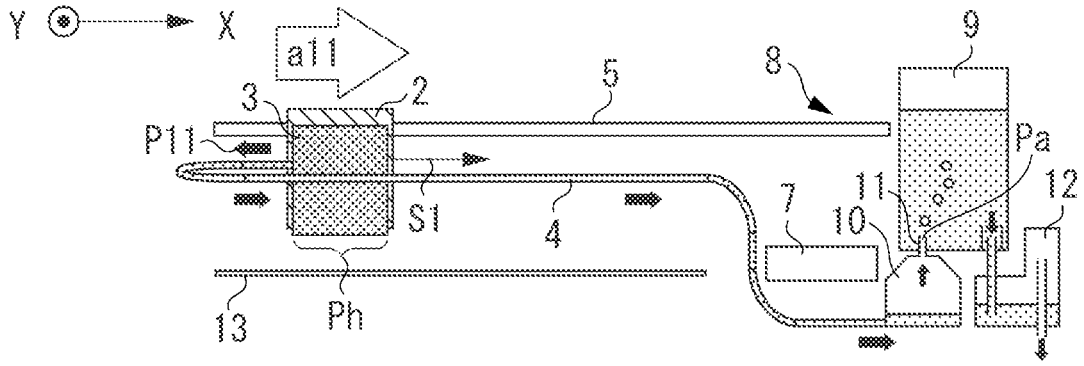
FIGS. 5A through 5F are schematic diagrams illustrating a sequence of ink filling into a sub-tank when reciprocating scanning is performed during a recording operation.
Figure 5B:
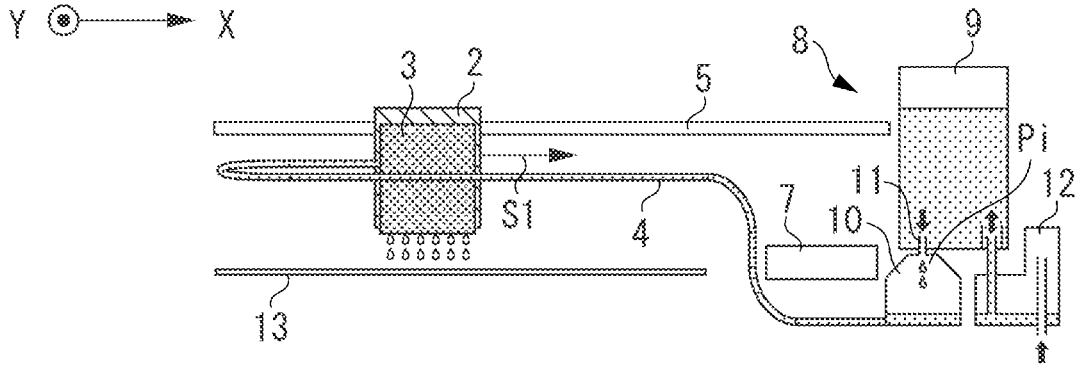
Figure 5C:
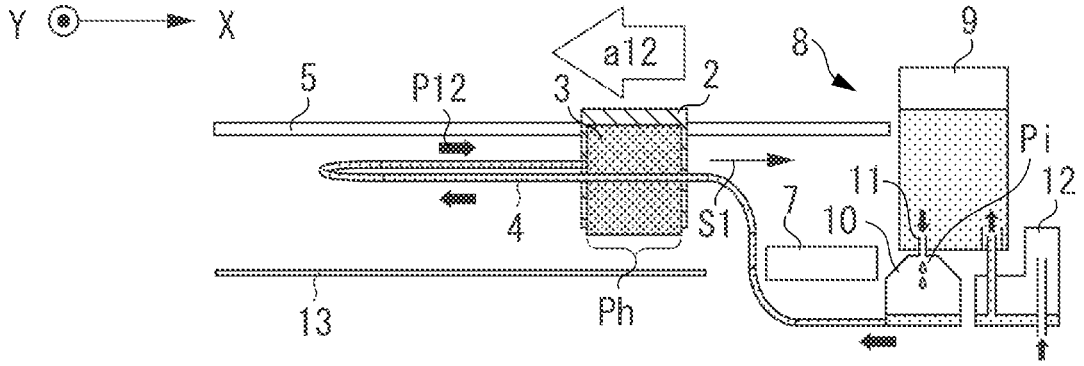
Figure 5D:
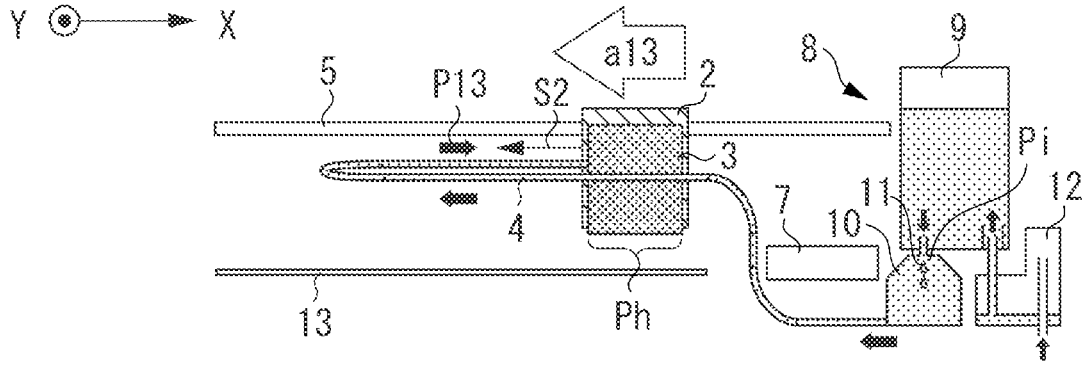
Figure 5E:
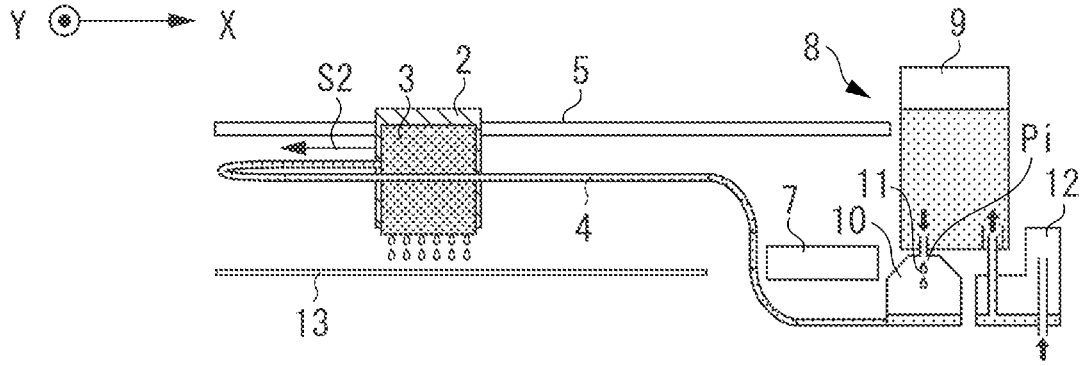
Figure 5F:
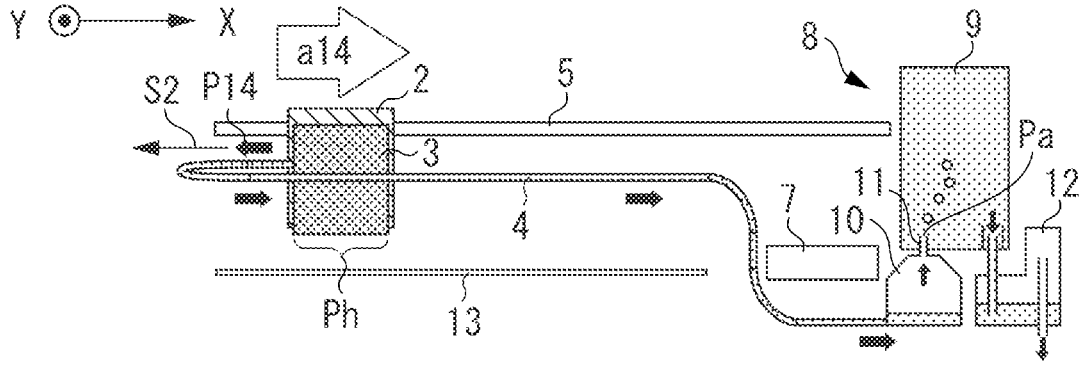

FIGS. 5A, 5B, 5C, 5D, 5E, and 5F are schematic diagrams illustrating operations performed when the sub-tank 10 is filled with ink by using dynamic pressure of the ink inside the supply tube 4 with a movement of the carriage 2 by scanning in an forward direction and a backward direction. One reciprocating movement of the carriage 2 is illustrated with FIGS. 5A to 5F in chronological order. Moreover, movement directions of the carriage 2 are indicated by arrows S1 and S2. Each of FIGS. 5A, 5B, and 5C illustrates a movement of the carriage 2 in the direction S1, whereas each of FIGS. 5D, 5E, and 5F illustrates a movement of the carriage 2 in the direction S2.

In FIGS. 5A, 5B, 5C, 5D, 5E, and 5F, dynamic pressures P11, P12, P13, and P14 act on the ink inside the supply tube 4 by accelerations a11, a12, a13, and a14, respectively. Moreover, a pressure resistance Pi to an ink movement inside the hollow tube 11, the pressure resistance Pa to an air movement inside the hollow tube 11, and a meniscus pressure-resistance Ph in a discharge port (not illustrated) of the recording head 3 are applied.

First, a movement of the air from the sub-tank 10 to the main tank 9 is described with reference to FIG. 5A.

The carriage 2 holding the recording head 3 is controlled by a control system (see FIG. 2) mounted on the inkjet recording apparatus main body such that the carriage 2 accelerates in the direction S1 with the acceleration a11. The supply tube 4 connected to the recording head 3 includes a section which moves by following a movement of the carriage 2. Herein, within the supply tube 4, the ink in the section, which moves by following the movement of the carriage 2, receives an inertial force generated by the acceleration a11. Since the supply tube 4 is arranged in parallel to the movement direction of the carriage 2, the ink having received the inertial force generated by the acceleration a11 is moved from the supply tube 4 to the sub-tank 10. The pressure generated at this time is the dynamic pressure P11 which acts on the ink inside the supply tube 4 with the acceleration a11.

Subsequently, the ink having received the dynamic pressure P11 is moved from the inside of the supply tube 4 to the sub-tank 10, thereby applying pressure to the inside of the sub-tank 10.

There is an air layer in an upper portion inside the sub-tank 10, and the air layer contacts the hollow tube 11. Herein, in a connection edge of the hollow tube 11 inside the main tank 9, the flow path resistance and the meniscus pressure-resistance are generated as the pressure resistance Pa to an air movement. That is, if the dynamic pressure P11 is higher than this pressure resistance Pa, the air is moved from the sub-tank 10 to the main tank 9. If the inside of the main tank 9 becomes pressurized by the air movement, the ink inside the main tank 9 is moved to the buffer chamber 12 via the communication tube 21. When the ink is moved into the buffer chamber 12, the air inside the buffer chamber 12 is pushed out via the atmosphere communication tube 22.

Moreover, the dynamic pressure P11 causes the ink to flow out from a reservoir of the recording head 3. The pressure generated at this time is adjusted by the pressure adjustment member 40. Since there is a limit that the pressure adjustment member 40 can adjust the amount of fluctuations, the dynamic pressure P11 may be desirably controlled to be lower than the meniscus pressure-resistance Ph in the discharge port of the recording head 3. Such control can prevent an inflow of the air from the discharge port of the recording head 3 to the inside of the recording head 3.

That is, the acceleration a11 is applied such that the dynamic pressure P11 (expressed as P1 in the below relational expression) of the ink inside the supply tube 4 becomes higher than the pressure resistance Pa to the air movement of the hollow tube 11 (P1>Pa). The application of such the acceleration a11 enables the air to be moved from the sub-tank 10 to the main tank 9. Moreover, if the acceleration a11 is set such that the dynamic pressure P11 is lower than the meniscus pressure-resistance Ph in the discharge port of the recording head 3 (see Expression (1)), the inflow of the air from the discharge port can be prevented.

$$Ph > P1 > Pa \qquad \text{Expression (1):}$$

FIG. 5B illustrates a state in which the carriage 2 reaches a predetermined speed (e.g., 25 inches/second) from the state illustrated in FIG. 5A, and moves in the direction S1 at a constant speed. During the movement at the constant speed, the pressure is not changed by the movement of the carriage 2, and the ink is not moved by the change of the dynamic pressure. In the state illustrated in FIG. 5B, ink of the amount corresponding to the amount of ink discharged from the recording head 3 by executing the recording operation is only moved from the main tank 9 to the sub-tank 10. An operation for pulling the air or ink may be performed, in response to states of the buffer chamber 12 and the communication tube 21, depending on negative pressure inside the main tank 9. Accordingly, the ink can continue to be supplied, and the recording operation is performed in the direction S1 according to a recording signal.

Next, a movement of the ink from the main tank 9 to the sub-tank 10 is described with reference to FIG. 5C. In the predetermined section as illustrated in FIG. 5B, the carriage 2 is moved in the direction S1 at the constant speed for the recording operation. Subsequently, the carriage 2 holding the recording head 3 is controlled by the control system (see FIG. 2) mounted on the recording apparatus main body such that the carriage 2 decelerates with a minus acceleration a12.

In the deceleration section, the ink inside the supply tube 4 receives an inertial force generated by the minus acceleration a12. Since the supply tube 4 is arranged in parallel to the movement direction of the carriage 2, the ink having received the inertial force is moved from the supply tube 4 toward a direction of the recording head 3. The pressure generated at this time is the dynamic pressure P12 to be applied to the ink inside the supply tube 4 by the acceleration a12.

The ink having received the dynamic pressure P12 is moved from the supply tube 4 to the recording head 3, and this movement reduces the pressure inside the sub-tank 10.

In the hollow tube 11, the flow path resistance and the meniscus pressure-resistance are generated as the pressure resistance Pi to an ink movement. Accordingly, when the dynamic pressure P12 becomes higher than this pressure resistance Pi, the ink is moved from the main tank 9 to the sub-tank 10. Herein, the inside of the main tank 9 is negatively pressurized. Consequently, if there is ink inside the communication tube 21 and the buffer chamber 12 as illustrated in FIG. 5C, the ink inside the buffer chamber 12 is pulled into the main tank 9 via the communication tube 21. On the other hand, if there is not ink inside the communication tube 21 or the buffer chamber 12, the air is pulled inside the 9 via the atmosphere communication tube 22, the buffer chamber 12, and the communication tube 21.

Moreover, the ink moved to the recording head 3 by the dynamic pressure P12 flows into the reservoir inside the recording head 3. The pressure generated at this time is adjusted by the pressure adjustment member 40. Since there is a limit that the pressure adjustment member 40 can adjust the amount of fluctuations, the dynamic pressure P12 may be desirably controlled to be lower than the meniscus pressure-resistance Ph in the discharge port of the recording head 3. Such control can prevent leakage of the ink from the discharge port of the recording head 3.

That is, the acceleration a12 is applied such that the dynamic pressure P12 (expressed as P2 in the relational expression below) of the ink inside the supply tube 4 becomes higher than the pressure resistance Pi to the ink movement of the hollow tube 11 (P2>Pi). The application of the acceleration a12 enables the ink to be moved from the main tank 9 to the sub-tank 10. Moreover, if the acceleration a12 is set such that the dynamic pressure P12 is lower than the meniscus pressure-resistance Ph in the discharge port of the recording head 3 (see Expression (2)), leakage of the ink from the discharge port can be prevented.

$$Ph>P2>Pi \qquad \text{Expression (2):}$$

When decelerating with the acceleration a12, the carriage 2 gradually reduces speed and becomes motionless. Then, the carriage 2 begins to move in the direction S2. FIG. 5D illustrates the state of acceleration of the carriage 2 in the direction S2. Herein, a direction of the acceleration a13 is the same as that of the acceleration a12, and the ink dynamic pressure P13 (expressed as P2 in the relational expression below) acts on the ink inside the tube. Since a pressure-resistance relation at this time satisfies the same relational expression as FIG. 5C, the ink is moved from the main tank 9 to the sub-tank 10 as similar to the state illustrated in FIG. 5C.

FIG. 5E illustrates a state in which the carriage 2 moves in the direction S2 at a constant moving speed (e.g., 25 inches/second) from the state illustrated in FIG. 5D. As similar to the state illustrated in FIG. 5B, a recording operation in the direction S2 is performed by discharging ink to the recording medium 13 during the movement of the carriage 2 at this constant speed.

After performing the recording operation during the movement at the constant speed in the predetermined section, the carriage 2 decelerates with the acceleration a14 as illustrated in FIG. 5F. Herein, a direction of the acceleration a14 is the same as that of the acceleration a11, and the dynamic pressure P14 (expressed as P1 in the relational expression) acts on the ink inside the tube. At this time, a pressure-resistance relation satisfies the same relational expression as that of FIG. 5A. That is, the air is moved from the sub-tank 10 to the main tank 9 as similar to the state illustrated in FIG. 5A.

Thus, the carriage 2 repeatedly performs the scanning in the forward direction and the backward direction, so that the sub-tank 10 is filled with the ink by using the changes in the dynamic pressure in the acceleration and deceleration area, particularly illustrated in FIGS. 5C and 5D.

One example configuration of the recording apparatus main body for such operations is as follows.

The sub-tank 10 has a volume of approximately 30 ml. The communication tube 21 has an inner diameter of approximately 1 mmΦ to 2 mmΦ and a length of approximately 25 mm to 30 mm. The communication tube 21 has an intrusion amount of substantially 0 mm into the inside of the sub-tank 10, and an intrusion amount of approximately 2.5 mm into the inside of the main tank 9. The supply tube 4 has an inner diameter of approximately 2 mmΦ to 2.5 mmΦ, and a length of approximately 650 mm to 1000 mm. The discharge port of the recording head 3 has a meniscus pressure-resistance with a negative pressure of approximately 5 kPa to 10 kPa.

Figure 6A:
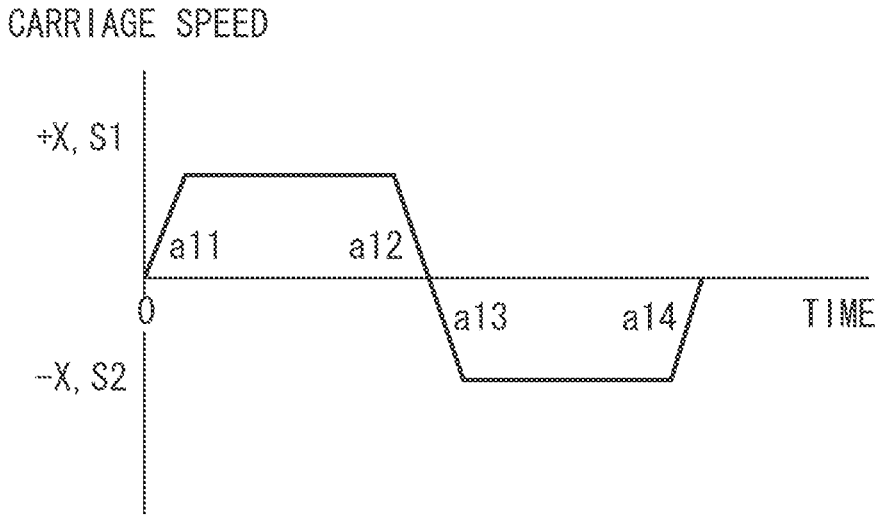
FIG. 6A is a diagram illustrating an example of moving speed of a carriage when reciprocating scanning is performed during a recording operation.
Figure 6B:
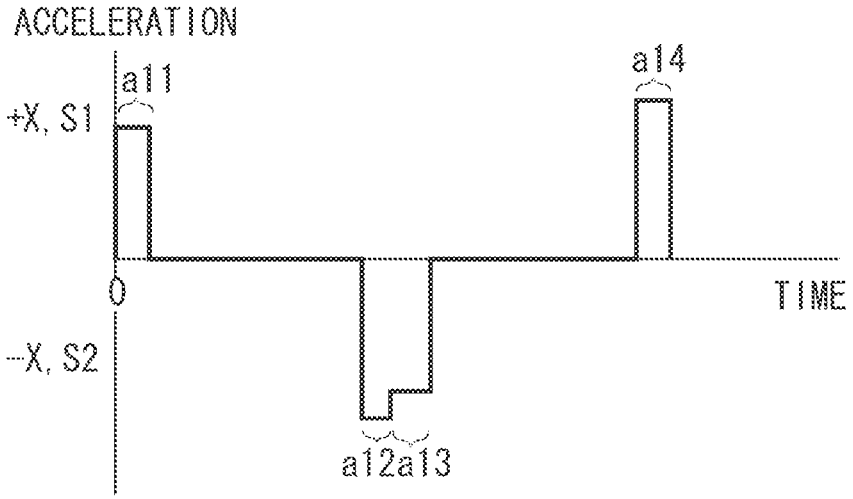
FIG. 6B is a diagram illustrating an example of an acceleration profile when reciprocating scanning is performed during a recording operation.

FIGS. 6A and 6B respectively illustrate an example of carriage speed and an example of acceleration profile of the carriage 2 in an ink filling operation to the sub-tank 10 during reciprocating scanning (also referred to as bidirectional recording). Assume that the direction S1 in each of FIGS. 5A, 5B, and 5C (a direction substantially the same as a direction indicated by an arrow X in each of FIGS. 5A, 5B, and 5C can be expressed as a plus X direction) is set to plus. The direction S2 in each of FIGS. 5D, 5E, and 5F (a direction opposite to a direction indicated by an arrow X in FIGS. 5D, 5E, and 5F can be expressed as a minus X direction) is set to minus.

As described with reference to FIGS. 5A, 5B, 5C, 5D, 5E, and 5F, the carriage scanning section of the recording apparatus has the acceleration/deceleration section and the constant speed section. The acceleration/deceleration section contributes to filling of the sub-tank 10 with ink. The recording apparatus in the present exemplary embodiment has the carriage scanning section of approximately 36 inches. However, the carriage scanning section is not limited thereto as long as the carriage 2 can perform scanning with the acceleration which generates the dynamic pressure having a predetermined relation in the acceleration/deceleration section.

In FIG. 6A, a horizontal axis indicates time, and a vertical axis indicates moving speed of the carriage 2. In FIG. 6B, a horizontal axis indicates time, and a vertical axis indicates acceleration of the carriage 2. In FIG. 6A, the carriage 2 is motionless at time 0. The carriage 2 begins to move in the direction S1 at the acceleration a11 (e.g., 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a12 (e.g., 230 inches/second$^2$), and eventually becomes motionless. Subsequently, the carriage 2 begins to move in the direction S2 at the acceleration a13 (e.g., 200 inches/second$^2$). After moving for a predetermined time, the carriage 2 reaches a predetermined speed (e.g., 25 inches/second) and moves at a constant speed. After moving further for a predetermined time, the carriage 2 decelerates with the acceleration a14 (e.g., 230 inches/second$^2$), and eventually becomes motionless.

More particularly, the dynamic pressure of the ink inside the supply tube 4 can be expressed as follows.

$$P_n=(m_n \cdot a_n)/S \qquad \text{Expression (3):}$$

$m_n$: mass of the ink to undergo acceleration
S: cross-sectional area of the supply tube 4
$a_n$: acceleration of the carriage 2

Moreover, a mass of the ink at the time when maximum dynamic pressure is generated is expressed as follows.

$$m_n=kSL_n \qquad \text{Expression (4):}$$

k: specific gravity of the ink
S: cross-sectional area of the supply tube 4
$L_n$: maximum length of the supply tube 4 to undergo inertia from acceleration Substitution of Expression (4) into Expression (3) yields the following relation.

$$Pn=kL_n a_n \qquad \text{Expression (5):}$$

That is, Ph>P1>Pa of Expression (1) and Ph>P2>Pi of Expression (2) can be converted into $Ph/(kL_1)>a_1>Pa/(kL_1)$ and $Ph/(kL_2)>a_2>Pi/(kL_2)$, respectively.

Thus, the carriage 2 during the recording operation is controlled to accelerate at acceleration satisfying the above relations, so that the sub-tank 10 can be filled with ink from the main tank 9 by using ink dynamic pressure generated in the supply tube 4. Consequently, the sub-tank 10 can be reliably filled with ink without interrupting a recording operation to spare time for an ink filling operation to the sub-tank 10.

When the sub-tank 10 is filled with a sufficient amount of ink in a state as illustrated in FIGS. 5A and 5F, the ink instead of the air is moved from the sub-tank 10 to the main tank 9 via the hollow tube 11. Thus, the ink filling operation to the sub-tank 10 using the dynamic pressure is not performed.

That is, when the recording apparatus including the main tank 9 and the sub-tank 10 performs a recording operation, the amount of ink used for recording and the amount of ink moved by using dynamic pressure are supplied from the main tank 9 to the sub-tank 10. Accordingly, the amount of ink in the sub-tank is increased by the amount of ink moved by using the dynamic pressure.

However, in a case where the amount of ink filled by using the dynamic pressure is not large, there is a possibility that the ink inside the main tank 9 is used up and replacement of the main tank 10 becomes necessary before the sub-tank 10 is filled with a sufficient amount of ink for a recording operation on a relatively large recording medium such as A0 and A1 sizes. In such a situation, a recording operation may have to be interrupted even though the sub-tank 10 is disposed. In case of such a situation, delicate changes in an ink discharge amount can occur, and unevenness and streaks on an image can be visually recognized, causing deterioration in image quality.

Now, the inkjet recording apparatus capable of preventing image quality deterioration and reducing the frequency of such forcible filing operations is described in detail.

Figure 7:
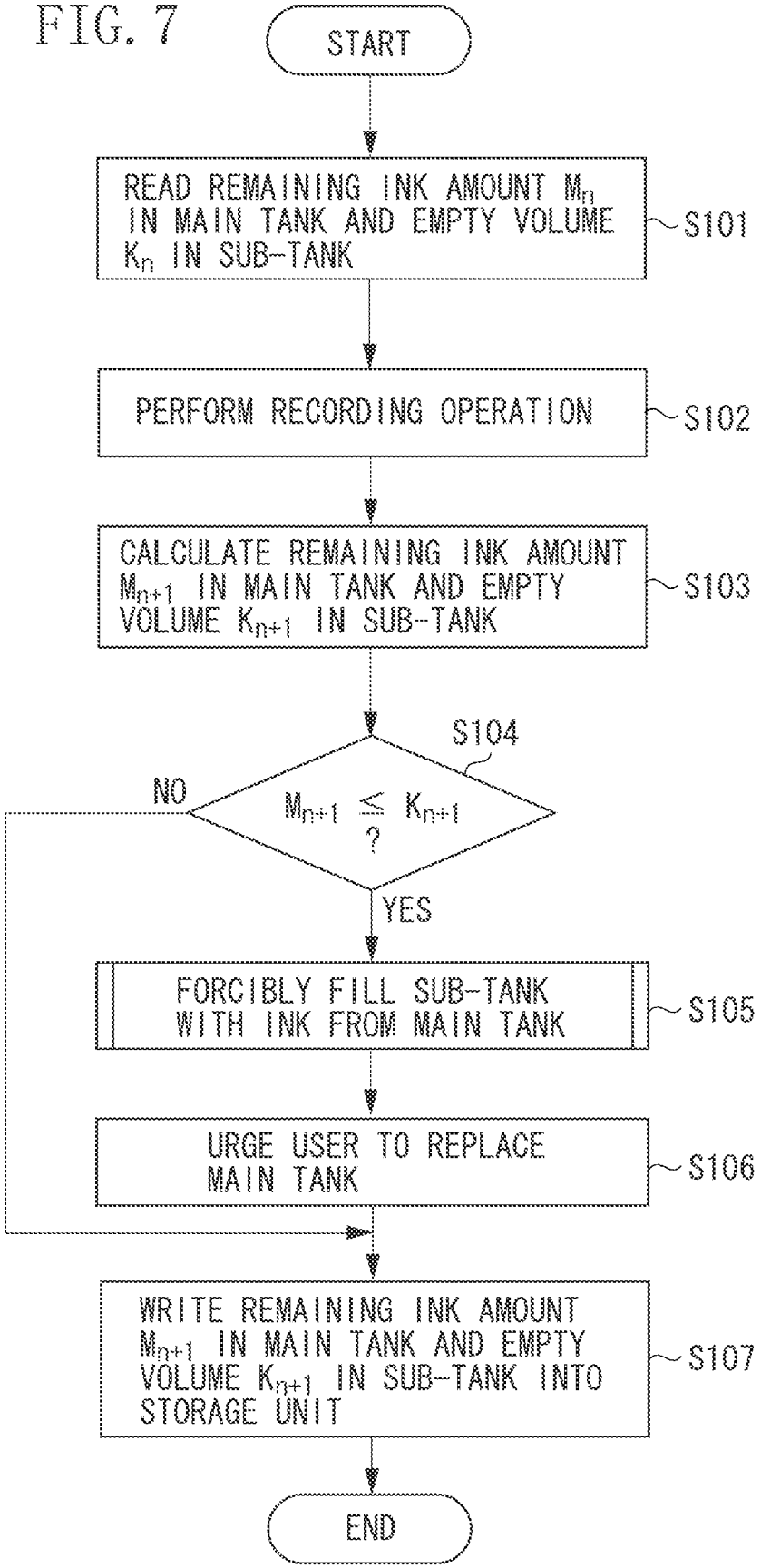
FIG. 7 is a flowchart illustrating ink filling timing according to a first exemplary embodiment.

FIG. 7 is a flowchart illustrating an ink filling operation indicating timing of supply control using the diaphragm valve 14 according to the first exemplary embodiment.

In step S101, the inkjet recording apparatus reads an ink volume (hereinafter, also referred to as a remaining ink amount) Mn (n=1, 2, 3 . . . ) in the main tank 9 and an empty volume Kn in the sub-tank 10. The remaining ink amount Mn and the empty volume Kn are stored in the recording apparatus main body.

In step S102, the inkjet recording apparatus performs a recording operation. In step S103, the inkjet recording apparatus calculates the remaining ink amount Mn+1 in the main tank 9 and the empty volume Kn+1 in the sub-tank 10 after the recording operation. The recording operation represents performance thereof in each of the direction S1 and the direction S2.

During the recording operation, the sub-tank 10 is filled with ink by using dynamic pressure, and the amount of ink in the main tank 9 is decreased by an ink movement amount a moved by the dynamic pressure. Moreover, the same amount of ink as an ink amount A used for the recording is supplied from the main tank 9 to the sub-tank 10. When the ink in the sub-tank 10 is used by the recording operation, pressure inside the sub-tank 10 is reduced, thereby supplying the ink by a difference of pressure between the inside of the sub-tank 10 and the main tank 9 with the atmosphere being released.

Moreover, the inkjet recording apparatus according to the present exemplary embodiment includes a dot counting unit for estimating the amount of ink used for recording based on image data. Accordingly, the ink amount A used for the recording can be calculated. Moreover, the ink amount a moving from the main tank 9 to the sub-tank 10 by using the dynamic pressure can be calculated based on a diameter of the supply tube 4 and acceleration.

The remaining ink amount $M_{n+1}$ in the main tank 9 and the empty ink volume $K_{n+1}$ in the sub-tank 10 after a recording operation can be calculated as follows:

$$M_{n+1}=M_n-A-\alpha \quad \text{Expression (6):}$$

$$K_{n+1}=K_n-\alpha \quad \text{Expression (7):}$$

$M_n$: ink volume in the main tank 9 before the recording operation $K_n$: empty volume in the sub-tank 10 before the recording operation A: ink amount used in the recording operation $\alpha$: ink amount moved from the main tank 9 to the sub-tank 10 by the dynamic pressure Next, in step S104, the remaining ink amount $M_{n+1}$ in the main tank 9 and the empty ink volume Kn+1 in the sub-tank 10 are compared as follows:

$$M_{n+1} \leq K_{n+1} \quad \text{Expression (8):}$$

If the remaining ink amount $M_{n+1}$ in the main tank 9 becomes less than or equal to the empty ink volume $K_{n+1}$ in the sub-tank 10, that is, Equation (8) is satisfied (YES in step S104), the operation proceeds to step S105. In step S105, the inkjet recording apparatus forcibly fills the sub-tank 10 with the ink from the main tank 9 using the diaphragm valve 14. This ink filling operation is performed after one image formation is finished.

In step S106, the inkjet recording apparatus urges a user to replace the main tank 9 since the main tank 9 becomes empty when the sub-tank 10 is forcibly filled with the ink from the main tank 9.

In step S107, the inkjet recording apparatus writes, into a storage unit, a remaining ink amount $M_{n+1}$ in the main tank 9 after the recording operation and an empty volume $K_{n+1}$ in the sub-tank 10 after the recording operation.

Expression (8) can also be written as Expression (9) based on Expressions (6) and (7).

$$M_n-A \leq K_n \quad \text{Expression (9):}$$

Therefore, without determining the ink amount a to be supplied to the sub-tank 10 by the dynamic pressure, the ink filling to the sub-tank 10 can be controlled based on a remaining ink amount M in the main tank 9 after the ink tank replacement, an empty volume K in the sub-tank 10 after the ink tank replacement, and the ink amount A used for the recoding.

In the present exemplary embodiment, moreover, the remaining ink amount M in the main tank 9 is calculated for each recording operation. However, in a case where the ink amount A to be used for a recording operation is small, the ink amount in the main tank 9 may be calculated every a plurality of recording operations in step S103 instead of each recording operation.

Thus, when an empty volume in the sub-tank 10 becomes greater than or equal to a remaining ink amount in the main tank 9 (an ink volume or more), the inkjet recording apparatus forcibly fills the sub-tank 10 with the ink. This can minimize the frequency of forcible filling operations, thereby preventing a decrease in recording efficiency caused by the forcible filling operations. Moreover, when the main tank 9 is replaced, a sufficient amount of ink to record one image can reliably be maintained inside the sub-tank 10, so that a recording operation is not interrupted during image printing, thereby preventing generation of unevenness and streaks on an image.

The first exemplary embodiment has been described using a case in which an ink amount A and an ink amount a supplied to the sub-tank 10 by dynamic pressure are used to estimate a remaining ink amount in the main tank 9 and an empty volume in the sub-tank 10, and then ink filling timing is controlled. A second exemplary embodiment will now be described using a case in which a main tank 9 includes thereinside a unit for determining a remaining ink amount therein by detecting a position of a liquid level of ink, and a sub-tank 10 includes thereinside a unit for determining an empty volume therein by detecting a liquid level of ink. The detection of ink amounts can enable ink filling timing to be controlled with higher accuracy.

Figure 8:
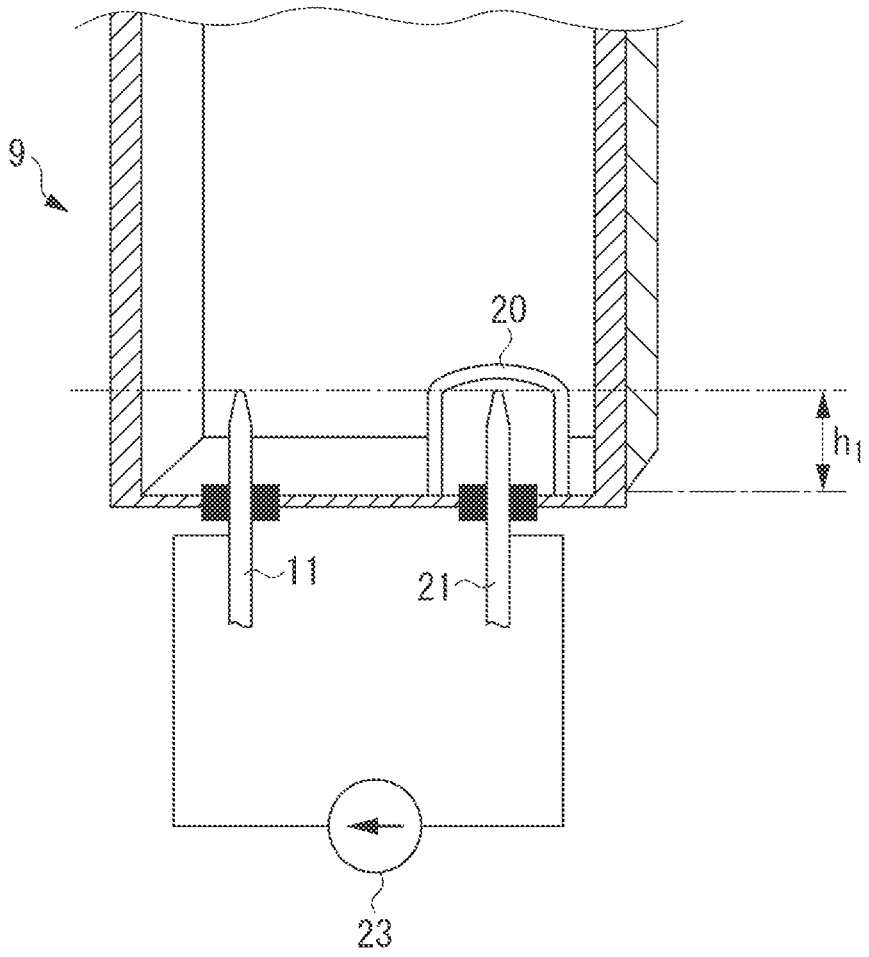
FIG. 8 is a schematic diagram illustrating a remaining ink amount detection sensor for a main tank according to a second exemplary embodiment.

FIG. 8 is a schematic diagram illustrating an ink detection sensor disposed inside the main tank 9 according to the present exemplary embodiment. FIG. 8 illustrates one portion of the main tank 9 in an installed state, and a hollow tube 11 and a communication tube 21 are connected to a lower portion of the main tank 9 in the direction of gravity. In the present exemplary embodiment, each of the hollow tubes 11 and the communication tube 21 is made of a metallic material having conductivity, for example, stainless. The hollow tubes 11 and the communication tube 21 are connected to a constant current circuit 23. In the inside of the main tank 9, a wall 20 having a height of h1 is disposed around a circumference of the communication tube 21.

That is, if a liquid level is higher than the height h1, an electric current flows through ink upon application of voltage from the constant current circuit 23. On the other hand, if a liquid level is lower the height h1, an electric current does not flow even with application of voltage from the constant current circuit 23. Accordingly, the liquid level of the ink inside the main tank 9 is detected, and a remaining ink amount inside the main tank 9 can be estimated with higher accuracy. Hereinafter, assume that the main tank 9 has an ink amount of Mh when the wall 20 has a height of h1.

Figure 9:
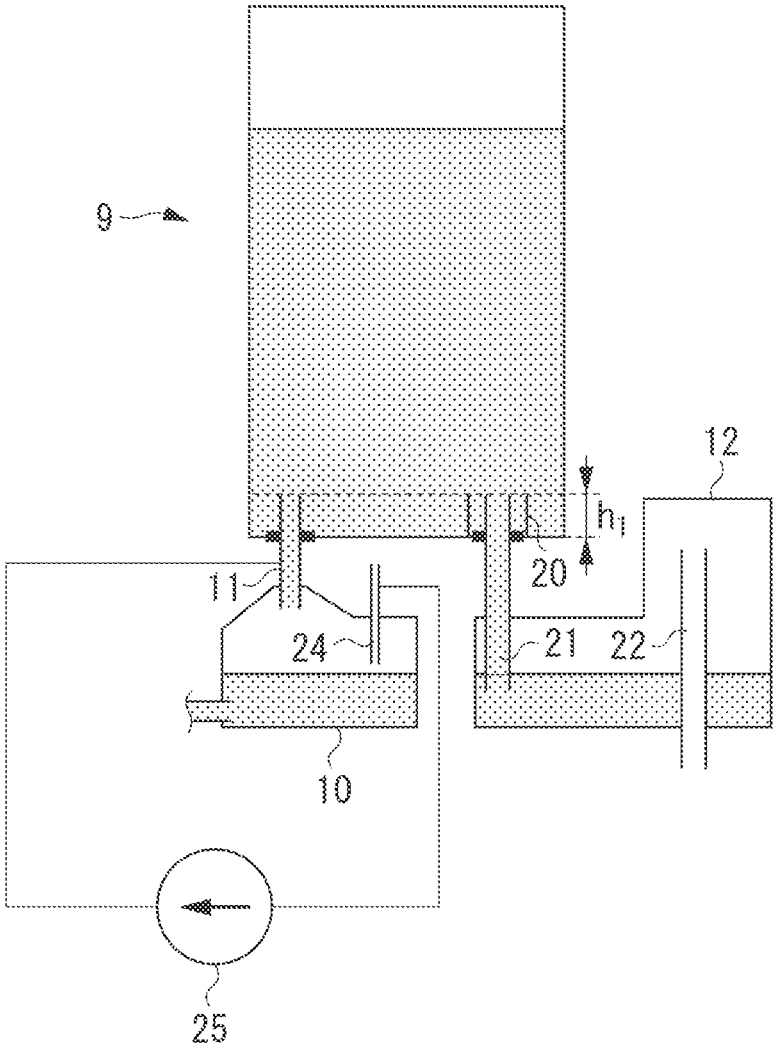
FIG. 9 is a schematic diagram illustrating a remaining ink detection sensor for a sub-tank according to the second exemplary embodiment.

Moreover, as illustrated in FIG. 9, the sub-tank 10 in the present exemplary embodiment has a detection sensor thereinside as similar to the main tank 9. In an upper portion of the sub-tank 10 in the direction of gravity, the hollow tube 11 and an electrode 24 made of metallic materials having conductivity are disposed. The hollow tube 11 and the electrode 24 are connected to a constant current circuit 25. If a liquid level of the ink in the sub-tank 10 is positioned on an upper side, in the direction of gravity, relative to a lower end of the hollow tube 11, an electric current flows through the ink upon application of voltage from the constant current circuit 25. On the other hand, if a liquid level of the ink in the sub-tank 10 is positioned on a lower side, in the direction of gravity, relative to the lower end of the hollow tube 11, an electric current does not flow even with application of voltage from the constant current circuit 25.

Thus, the timing at which a position of a liquid level inside the sub-tank 10 has become lower than the lower end of the hollow tube 11 can be detected with higher accuracy. That is, estimation of an empty volume Kx in the sub-tank 10 based on the dot counting after the detection can estimate an empty ink volume inside the sub-tank 10 with higher accuracy.

A height of the wall 20 of the main tank 9 is set to satisfy Kh≥Mh, where Kh is an empty ink volume inside the sub-tank 10 when a minimum necessary ink amount in the sub-tank 10 for one image recording is Lh.

The empty volume Kx in the sub-tank 10 can be a value including a variation beforehand in consideration of a detection variation associated with detection at regular intervals (e.g., every several m seconds to several seconds) by the constant current circuit 25, and a liquid level detection variation associated with meniscus or bubble of ink.

Particularly, the main tank 9 is arranged such that an ink amount (Mh) is detected by the remaining amount detection sensor upon reaching 10 ml. In the sub-tank 10, the hollow tube is adjusted such that a full-up amount (L0) of the ink inside the sub-tank 10 is 29 ml, and a minimum necessary ink amount (Lh) inside the sub-tank 10 for one image recording is set to 10 ml.

Figure 10:
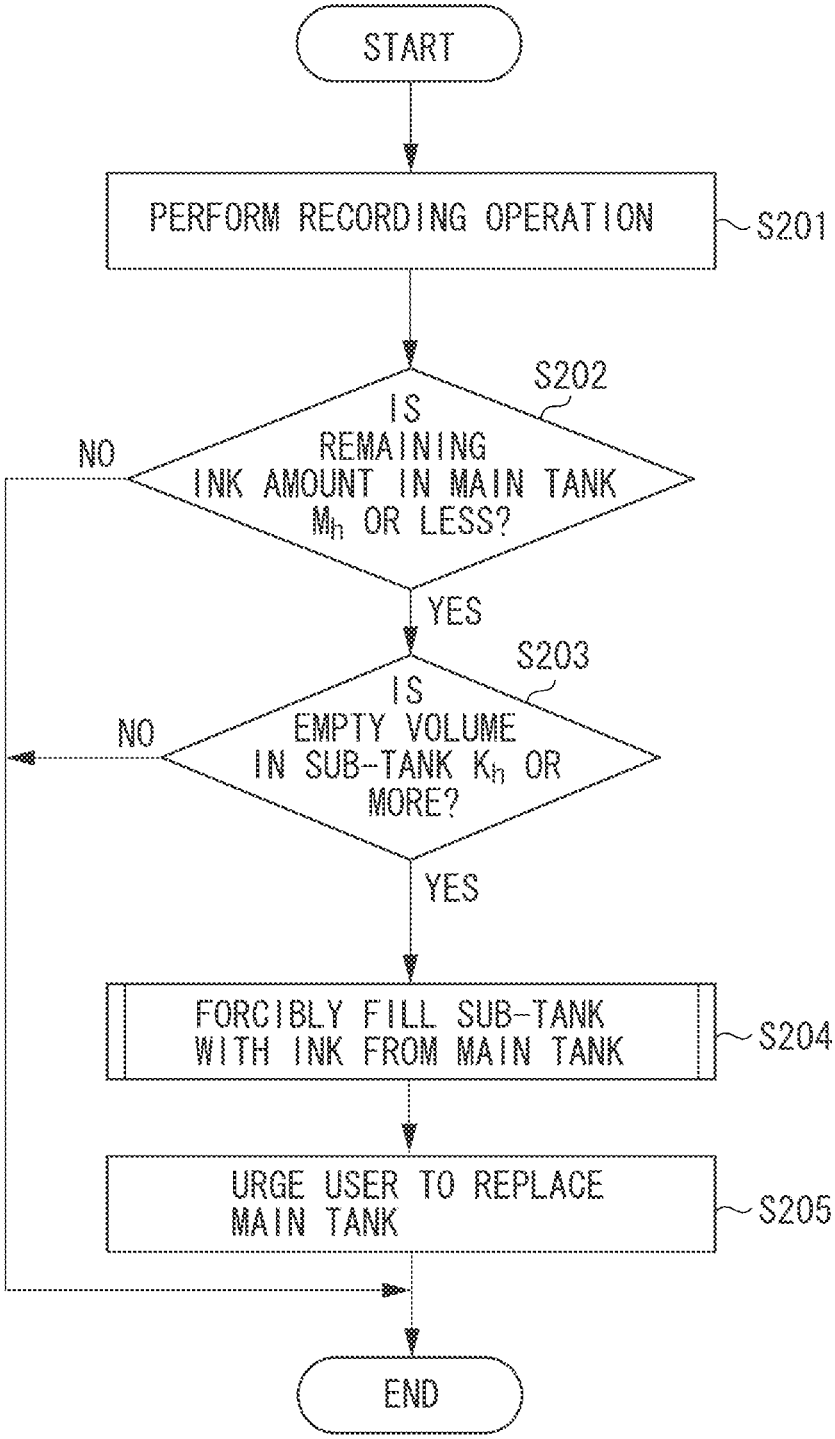
FIG. 10 is a flowchart illustrating ink fill timing according to the second exemplary embodiment.

FIG. 10 is a flowchart illustrates the timing of a forcible ink filling operation using a diaphragm valve when the detection sensors are disposed.

In step S201, an inkjet recording apparatus performs a recording operation. In step S202, the inkjet recording apparatus uses the constant current circuit 23 to detect whether the liquid level of the ink inside the main tank 9 after the recording operation is lower than the height h1, that is, whether a remaining ink amount in the main tank 9 is Mh or less. If the remaining ink amount is not Mh or less (NO in step S202), the processing ends without performing the forcible filling operation by a diaphragm valve 14.

If the remaining ink amount is Mh or less (YES in step S202), then in step S203, the inkjet recording apparatus determines whether an empty volume of the ink inside the sub-tank 10 is Kh or more. If the empty volume is not Kh or more (NO in step S203), the processing ends without performing the forcible filling operation by using the diaphragm valve 14.

If the empty volume of the ink inside the sub-tank 10 is Kh or more (YES in step S203), then in step S204, the inkjet recording apparatus forcibly fills the sub-tank 10 with the ink from the main tank 9 by using the diaphragm valve 14. Since the empty volume Kh of the ink in the sub-tank 10 and the ink amount Mh in the main tank 9 are arranged to satisfy Mh≤Kh, the main tank 9 becomes empty after the forcible filling operation.

In step S205, the inkjet recording apparatus urges a user to replace the main tank 9.

That is, the inkjet recording apparatus controls the forcible filling operation not to be performed until when the remaining ink amount in the main tank 9 becomes Mh or less, and the empty volume in the sub-tank 10 becomes Kh or more. On the other hand, if the remaining ink amount in the main tank 9 is Mh or more, and an empty volume in the sub-tank 10 is Kh or more, the forcible filling operation is not performed since there is a possibility that the empty volume in the sub-tank 10 becomes less than Kh by the ink filling operation using the dynamic pressure. Such control can minimize the frequency of forcible ink filling operations, thereby preventing a decrease in recording efficiency caused by the forcible filling operations. Moreover, when the main tank 9 is replaced, a sufficient amount of ink to record one image can reliably be maintained inside the sub-tank 10, so that a recording operation is not interrupted during image printing, thereby preventing generation of unevenness and streaks on an image.

Each of the exemplary embodiments of the present invention is described using the large inkjet recording apparatus performing recording on a recording medium such as A1 size and A0 size. However, the exemplary embodiments are not limited thereto. The exemplary embodiments of the present invention may be applied to a business printer performing recording on various types of recording media such as A3 size, and A4 size or smaller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-100963 filed Apr. 26, 2012, which is hereby incorporated by reference herein in its entirety.

What is claimed is:

1. An inkjet recording apparatus comprising:

a recording head configured to perform a recording operation to discharge ink;

a carriage configured to move with the recording head mounted thereon;

a main tank configured to store ink;

a sub-tank configured to be supplied ink from the main tank;

a hollow tube that connects the main tank and the sub-tank;

a supply tube configured to supply ink from the sub-tank to the recording head, the supply tube moves by following a movement of the carriage;

a supply unit connected to the supply tube and configured to perform a supply operation to supply ink from the main tank to the sub-tank; and a control unit configured to control acceleration of the carriage such that a dynamic pressure of ink inside the supply tube becomes greater than a pressure resistance to an ink movement and a pressure resistance to an air movement in the hollow tube;

wherein the control unit stops the recording operation and makes the supply unit perform the supply operation based on an ink volume of the main tank and an ink volume of the sub-tank.

2. The inkjet recording apparatus according to claim 1, wherein the control unit further comprises determining a remaining ink amount in the main tank and determining the empty volume in the sub-tank.

3. The inkjet recording apparatus according to claim 2, wherein determining the remaining ink amount includes detecting a position of a liquid level of ink inside the main tank.

4. The inkjet recording apparatus according to claim 2, wherein determining the empty volume includes detecting a position of a liquid level of ink inside the sub-tank.

5. The inkjet recording apparatus according to claim 1, wherein the supply unit is a diaphragm valve supplying ink from the main tank to the sub-tank by changing a volume thereof.

6. The inkjet recording apparatus according to claim 1, wherein, when a recording operation is not performed, the control unit causes the supply unit to fill the sub-tank with ink from the main tank.

7. The inkjet recording apparatus according to claim 1, wherein the hollow tube connects a lower portion of the main tank and an upper portion of the sub-tank in a direction of gravity.

8. The inkjet recording apparatus according to claim 1, wherein the supply tube includes a portion which moves by following a movement of the carriage.

9. The inkjet recording apparatus according to claim 1, wherein the control unit is further configured to control acceleration of the carriage such that an ink dynamic pressure inside the supply tube becomes smaller than a meniscus pressure-resistance in the recording head.

10. The inkjet recording apparatus according to claim 1, wherein the sub-tank is hermetically closed except for portions connected to the supply tube and the hollow tube.

11. A method for filling, with ink, a sub-tank of an inkjet recording apparatus that includes a recording head configured to perform a recording operation to discharge ink, a carriage configured to move with the recording head mounted thereon, a main tank configured to store ink, the sub-tank configured to be supplied from the main tank, a hollow tube that connects the main tank and the sub-tank, and a supply tube configured to supply ink from the sub-tank to the recording head, the supply tube moves by following a movement of the carriage, the method comprising:

a dynamic pressure filling step of filling the sub-tank with ink from the main tank by controlling acceleration of the carriage; and a forcible filling step of filling the sub-tank with ink from the main tank using a supply unit connected to the supply tube when an empty volume in the sub-tank is greater than or equal to an ink volume in the main tank, wherein the control unit stops the recording operation and performs a supply operation based on an ink volume of the main tank and an ink volume of the sub-tank.

12. The method according to claim 11, wherein the dynamic pressure filling step includes:

accelerating the carriage in a forward direction by a carriage motor;

decelerating the carriage in the forward direction by the carriage motor;

accelerating the carriage in a backward direction by the carriage motor; and decelerating the carriage in the backward direction by the carriage motor.

13. The method according to claim 11, wherein the forcible filling step is performed when a recording operation is not performed.

14. The method according to claim 11, wherein the forcible filling step supplies ink to the sub-tank by changing a volume of a volume-changeable diaphragm valve.

15. The method according to claim 11, wherein, in the dynamic pressure filling step, acceleration of the carriage is controlled such that an ink dynamic pressure inside the supply tube becomes smaller than a meniscus pressure-resistance in the discharge port.

* * * * *